US007618502B2

(12) United States Patent
Sato et al.

(10) Patent No.: US 7,618,502 B2
(45) Date of Patent: Nov. 17, 2009

(54) WEAR RESISTANT ALUMINUM ALLOY ELONGATE BODY, MANUFACTURING METHOD THEREOF AND PISTON FOR CAR AIR CONDITIONER

(75) Inventors: Shinichi Sato, Kariya (JP); Takayuki Kato, Kariya (JP); Norikazu Deto, Kariya (JP); Masashi Nojiri, Kariya (JP); Toshiya Ikeda, Osaka (JP); Yoshihiro Nakai, Osaka (JP); Yoshiki Kishikawa, Shinminato (JP); Kiyotaka Utsunomiya, Shinminato (JP)

(73) Assignees: Sumitomo Electric Industries, Ltd., Osaka (JP); Toyoda Automatic Loom Works, Ltd., Aichi (JP)

( * ) Notice: Subject to any disclaimer, the term of this patent is extended or adjusted under 35 U.S.C. 154(b) by 167 days.

(21) Appl. No.: 11/822,190

(22) Filed: Jul. 3, 2007

(65) Prior Publication Data

US 2007/0251666 A1 Nov. 1, 2007

Related U.S. Application Data

(62) Division of application No. 10/196,211, filed on Jul. 17, 2002, now abandoned.

(30) Foreign Application Priority Data

Jul. 17, 2001 (JP) ..... 2001-216763

(51) Int. Cl.
*C22F 1/043* (2006.01)

(52) U.S. Cl. ..... 148/551; 148/696

(58) Field of Classification Search ..... 148/551, 148/696, 552

See application file for complete search history.

(56) References Cited

U.S. PATENT DOCUMENTS 4,077,810 A 3/1978 Ohuchi et al.

(Continued)

FOREIGN PATENT DOCUMENTS

DE 41 33 937 A1 4/1993

(Continued)

OTHER PUBLICATIONS

Aluminium-Taschenbuch, 14th ed. Aluminium-Verlag, Dusseldorf 1983, pp. 509 to 512 and 529 to 533.

(Continued)

*Primary Examiner*—Roy King
*Assistant Examiner*—Janelle Morillo
(74) *Attorney, Agent, or Firm*—McDermott Will & Emery LLP

(57) ABSTRACT

The wear resistant aluminum alloy elongate body contains 7-13 mass % of Si, 0.001-0.3 mass % of iron, 2.0-5.0 mass % of Cu, 0.3-1.0 mass % of Mg, 0.001-0.3 mass % of Mn, 0.001-0.3 mass % of Cr, 0.003-0.03 mass % of Sr, 0.005-0.05 mass % of Ti, and the remaining part of Al and unavoidable impurity. The size of Si grains existing in the elongate body is, by the average value, at most 10 μm and by the maximum value, at most 30 μm, and the size of the Si grains in the range of down to 1.5 mm deep from the surface is, by the maximum value, at most 6 μm. Further, crystal texture of Al alloy is one selected from the group consisting of hot rolled texture, re-crystallized texture and mixed texture of hot rolled texture and re-crystallized texture.

3 Claims, 4 Drawing Sheets

U.S. PATENT DOCUMENTS

| | | | | |
|---|---|---|---|---|
| 4,973,363 | A * | 11/1990 | Hayato et al. | 148/549 |
| 2003/0143102 | A1 * | 7/2003 | Matsuoka et al. | 420/546 |

FOREIGN PATENT DOCUMENTS

| | | |
|---|---|---|
| JP | 64-17834 | 1/1989 |

OTHER PUBLICATIONS

"Aluminum and Aluminum Alloys", ASM International, 1993, pp. 367-369, 534.

* cited by examiner

WEAR RESISTANT ALUMINUM ALLOY ELONGATE BODY, MANUFACTURING METHOD THEREOF AND PISTON FOR CAR AIR CONDITIONER

This application is a Divisional of U.S. application Ser. No. 10/196,211, filed Jul. 17, 2002, abandoned claiming priority of Japanese Application No. 2001-216763, filed Jul. 17, 2001, the entire contents of each of which are hereby incorporated by reference.

BACKGROUND OF THE INVENTION

1. Field of the Invention

The present invention relates to a wear resistant aluminum alloy elongate body having superior shear-cutting property, manufacturing method thereof, and to a piston for a car air conditioner including the wear resistant aluminum alloy elongate body.

2. Description of the Background Art

Cast aluminum alloy containing 7 to 13 mass % of silicon, 2.0 to 5.0 mass % of copper and 0.3 to 1.0 mass % of magnesium is light weight and has superior wear resistance and mechanical properties. Therefore, the alloy has been used for a member such as a piston for a car air conditioner, which requires such superior characteristics. In the alloy of this type, in order to attain both wear distance and mechanical properties, the amount of crystallized silicon grains is controlled.

Japanese Patent Laying-Open No. 64-17834, for example, proposes a representative high strength wear resistant aluminum alloy. The aluminum alloy disclosed in this laid-open application is manufactured by casting, such as continuous casting or semi-continuous casting of fixed molding method, at a high cooling rate. In the inner texture of the cast bar manufactured by this method, the size of the eutectic silicon grains is at most 8 μm, the grain size is uniform and the grains are distributed uniformly. To the aluminum alloy in this example, in order to reduce the size of the silicon grains, titanium and boron are added to be at most 0.25 mass % in total, and after casting, cooling is performed at a rate of at least 4° C./sec. As a result, surface hardness is controlled to be 67 to 75 according to F scale of Rockwell hardness. Further, an appropriate amount of alloy component is added to enhance toughness of aluminum alloy matrix. This is to solve the following problem. Namely, in a cast bar used with the cast texture intact, silicon grains are segregated at the grain boundary at the time of solidification, and at the time of shear-cutting, a crack changes its direction along the segregated silicon grains, making it difficult to obtain a smooth cut surface.

By such measures, the aluminum alloy disclosed in the aforementioned laid-open application comes to have flat shear surface when shear-cut, and becomes less susceptible to brittle damage, namely, the aluminum alloy has a so-called satisfactory shear-cutting property.

The method of manufacturing aluminum alloy disclosed in the aforementioned laid-open application, however, involves high cost of facilities to perform rapid cooling after casting, and production efficiency is not very high, as the manufacturing process is semi-continuous.

Therefore, the inventors have studied a manufacturing method that does not involve the above described rapid cooling step and that enhances production efficiency in continuous casting. As a result, it has been found that an alloy having superior shear-cutting property can be obtained by a continuous casting method with higher production efficiency that combines a continuous casting machine of movable molding method represented by a Properzi continuous casting machine with hot rolling, though the range of silicon grain distribution widens.

The continuously cast rolled member obtained by the method studied by the inventors consists of hot rolling texture, re-crystallized texture, or a mixed texture of hot rolling texture and re-crystallized texture. Therefore, at the time of shear-cutting, the member exhibits more satisfactory cross section than the conventional cast bar in which coarse silicon grains are segregated at the grain boundary of the matrix.

When the casting method is used, a perspiration zone, a ripple mark, an external damage or the like is generated on the surface of the ingot. When such defects are not removed, cutting crack results at the time of shear-cutting, forging crack results at the time of forging, and fatigue strength and the like degrade in the final product. Therefore, generally, surface cutting process is performed before shear-cutting.

The surface cutting of an elongate body includes a peeling process for scraping by a cutting tool, and a dice-skinning process for scraping by means of a fixed dice.

FIG. 6 represents the peeling process in which the surface of the workpiece 1 is scraped off by using a cutting tool 2. FIG. 7 represents the dice-skinning process in which the surface of workpiece 1 is scraped off by a fixed dice. Generally, productivity of dice-skinning process is higher than that of peeling process. The dice-skinning process, however, is difficult in casting in accordance with the conventionally performed fixed molding method including the one disclosed in Japanese Patent Laying-Open No. 64-17834, because of the following restrictions, and hence the peeling process has been used.

Namely, the cast bar manufactured by continuous casting of fixed molding method has cast texture, and therefore, dice-skinning process is not possible. In the dice-skinning process, referring to FIG. 7, a dice consisting of a pair of centering dices 3 and a skinning dice 4 is used. The centering dice 3 performs, though to a small extent, cold working on the workpiece, for centering of workpiece 1 introduced to the skinning dice 4. Here, the cast bar as the workpiece cannot withstand the cold working, and is fractured.

By contrast, a continuously molded rolled member has better processability as compared with the cast bar and withstands cold working, as hot rolling texture is formed by the hot rolling step. The aluminum alloy having compositions disclosed to date, however, suffers from the problems of fracture and surface peeling off (surface roughening), when the continuously cast rolled member is subjected to dice-skinning process.

SUMMARY OF THE INVENTION

Therefore, an object of the present invention is to provide a wear resistant aluminum alloy elongate body having superior shear-cutting property and both high fatigue strength and high wear resistance that can withstand dice scanning process, a manufacturing method thereof, and a piston for car air conditioner including the wear resistant aluminum alloy elongate body.

The wear resistant aluminum alloy elongate body in accordance with the present invention contains at least 7 mass % and at most 13 mass % of silicon (Si), at least 0.001 mass % and at most 0.3 mass % of iron (Fe), at least 2.0 mass % and at most 5.0 mass % of copper (Cu), at least 0.3 mass % and at most 1.0 mass % of magnesium (Mg), at least 0.001 mass % and at most 0.3 mass % of manganese (Mn), at least 0.001 mass % and at most 0.3 mass % of chromium (Cr), at least 0.003 mass % and at most 0.03 mass % of strontium (Sr), and at least 0.005 mass % and at most 0.05 mass % of titanium (Ti), and the remaining part of aluminum (Al) and an unavoidable impurity. The size of the silicon grains existing in the aluminum alloy elongate body is 10 μm or smaller in average and 30 μm or smaller as the maximum value, and the size of the silicon grains existing in a range of 1.5 mm deep from the surface is 6 μm or smaller as the maximum value. Further, crystal texture of aluminum alloy is one selected from the group consisting of hot rolled texture, re-crystallized texture, and a mixed texture of hot rolled texture and re-crystallized texture.

In the wear resistant aluminum alloy elongate body of the present invention, particularly in order to improve dice-skinning property, the content of iron should preferably be in the range of higher than 0.2 mass % and at most 0.3 mass %.

In the wear resistant aluminum alloy elongate body in accordance with the present invention, particularly in order to improve shear-cutting property, surface hardness of the aluminum alloy should preferably be in the range of at least 50 and at most 90 of Rockwell hardness F scale.

Further, in order to prevent crack biasing resulting from unevenness on the surface at the time of shear-cutting process, surface roughness of aluminum alloy should preferably be made at most 10 μm in terms of Rmax.

Preferably, the piston for car air conditioner in accordance with the present invention employs the wear resistant aluminum alloy elongate body including the above described structure.

The method of manufacturing the wear resistant aluminum alloy elongate body in accordance with the present invention includes the following steps.

(a) The step of obtaining a cast body, by continuous casting of aluminum alloy such that secondary arm spacing of dendrite is at most 40 μm.

(b) The step of obtaining a rolled body by hot rolling the cast body at a temperature range of at least 350° C. and at most 500° C. with reduction of processing being at least 40%.

(c) The step of heat-treating the rolled body in a temperature range of at least 300° C. and at most 480° C. for at least 2 hours and at most 50 hours.

When the aluminum alloy elongate body is manufactured through the above described manufacturing method, the dice-skinning process of the resulting rolled body is facilitated.

It is noted that in the aluminum alloy disclosed in Japanese Patent Laying-Open No. 64-17834, dendritic secondary grains surely exist as plumate crystal when viewed microscopically. The texture, however, mainly consist of columnar crystal when viewed macroscopically, and hence the texture is different from that of the aluminum alloy obtained in accordance with the present invention.

Further, in the method of manufacturing wear resistant aluminum alloy elongate body of the present invention, preferably, the dice-skinning process is performed on the surface of the rolled body, after the step of heat treatment.

When the dice-skinning process is to be performed, the surface hardness of the rolled body is preferably controlled to be within the range of at least 45 and at most 85 of Rockwell hardness F scale, before the step of performing the dice-skinning process. Further, in the step of dice-skinning process, the amount of skinning by the dice is, preferably, at most 1 mm.

The wear resistant aluminum alloy elongate body in accordance with the present invention is suitable for an application that requires high wear resistance, such as a piston for car air conditioner. Specifically, as the body is subjected to continuous casting and rolling, when a processed surface orthogonal to the flow (alignment) along the longitudinal direction generated in the texture of the resulting aluminum alloy is placed at a portion to be the sliding surface, for example, at a shoe receiving portion of a swash type compressor piston, wear resistance can remarkably be improved.

As described above, according to the present invention, a wear resistant aluminum alloy elongate body that has high fatigue strength and high wear resistance and in addition, has superior shear-cutting property and dice-skinning property can be obtained. Thus, a material suitable for a member that requires superior wear resistance such as a piston for car air conditioner, can be provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
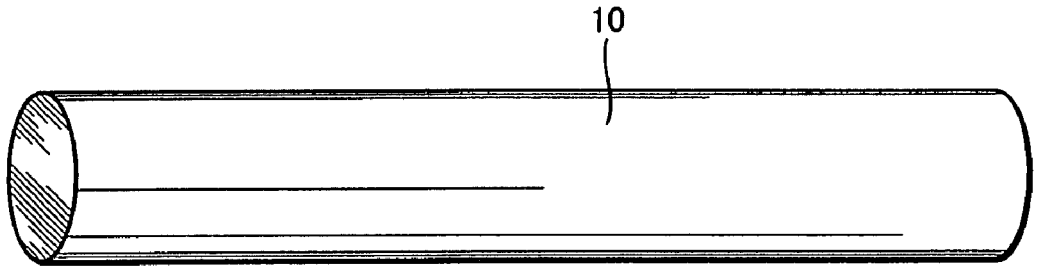
FIG. 1 is a perspective view showing a wear resistant aluminum alloy elongate body as an embodiment of the present invention.

A wear resistant aluminum alloy elongate body 10 such as shown in FIG. 1 will be described in detail, as an embodiment of the present invention.

Contents of various component elements of the aluminum alloy in accordance with the present invention are limited from the following reasons.

Figure 2:
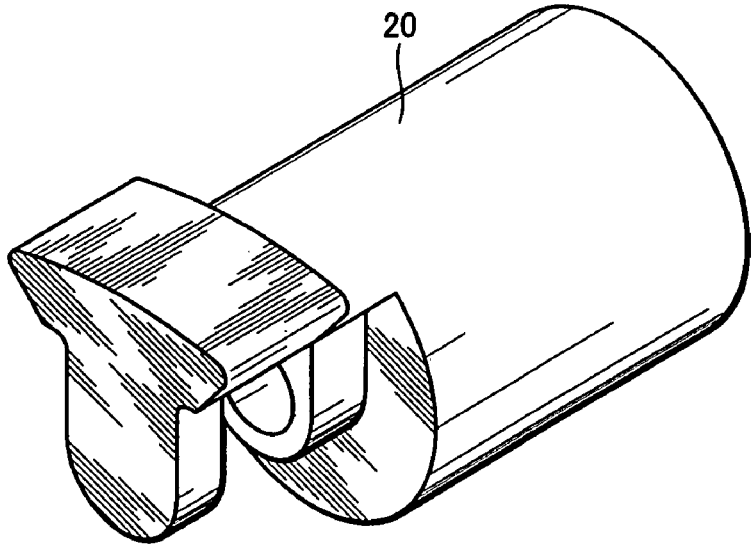
FIG. 2 is a perspective view showing a piston for car air conditioner as another embodiment of the present invention.

Addition of copper and magnesium determines strength. If the amount of these is too small, strength would be insufficient, and if the amount is too large, brittleness sets in. For an application that requires high wear resistance such as the piston 20 for car air conditioner shown in FIG. 2, considering wear resistance and dice-skinning property, it is necessary that the copper content is in the range of 2.0 mass % to 5.0 mass %, and magnesium content is in the range of 0.3 mass % to 1.0 mass %.

Amount of addition, grain diameter and grain diameter distribution of silicon have influence on wear resistance and fatigues strength. Control of the grain diameter and the grain diameter distribution much depends on the manufacturing method. According to Japanese Patent Laying-Open No. 64-17834, manufacturing method includes casting with relatively high cooling rate. In the present invention, distribution and variation of cooling rate are allowed, and therefore the size of the crystallized silicon grains tends to be larger. Different from the manufacturing method disclosed in Japanese Patent Laying-Open No. 64-17834, however, increase in size of the silicon grains is suppressed by adding strontium, and variation in silicon grain diameter is moderated by heat treatment, thereby the grain diameter and grain diameter distribution of silicon grains can be controlled. Though strontium is effective to make smaller the primary crystal silicon, the amount of addition thereof is set to the range of 0.003 mass % to 0.03 mass %. When the content of strontium exceeds 0.03 mass %, the effect of making smaller the silicon grains is saturated, while gas absorption increases significantly. When the content of strontium is smaller than 0.003 mass %, the effect of making smaller the silicon grains is not recognized.

In the aluminum alloy in accordance with the present invention, the upper limit of the amount of added silicon is limited to the eutectic composition. Therefore, expansion of eutectic point is recognized when solidified in non-equilibrium state, and therefore the upper limit of silicon content is set to 13 mass %. When silicon content is small, the aluminum alloy primary crystal ($\alpha$ phase) becomes coarse, and therefore, the lower limit of silicon content is set to 7 mass %.

Titanium is necessary to make smaller the $\alpha$ phase. When the content of titanium is smaller than 0.005 mass %, the effect of making smaller is marginal, and when titanium is added by more than 0.05 mass %, the effect is again marginal.

The iron content is from 0.001 mass % to 0.3 mass %, manganese content is from 0.001 mass % to 0.3 mass %, and chromium content is from 0.001 mass % to 0.3 mass %.

When iron content is too large, coarse crystals of other added elements in the alloy tend to form at the time of solidification of the aluminum alloy, possibly damaging mechanical characteristic of the alloy. Therefore, the iron content is set to be at most 0.3 mass %. Therefore, content of manganese and chromium that form coarse crystallized substances with iron are also set to be at most 0.3 mass %.

In order to improve both shear-cutting property and skinning property, the iron content should be larger than 0.2 mass % and at most 0.3 mass %.

Further, in the present invention, in order to prevent crack biasing phenomenon at the time of shear-cutting and to ensure dice-skinning property as will be described later, the size of silicon grains existing therein is controlled to be 10 μm or smaller in average, and 30 μm or smaller as the maximum value. Further, the size of silicon grains in the range of down to 1.5 mm deep from the surface is set to be 6 μm or smaller by the maximum value.

Unless the size of the silicon grains is not controlled in this manner, an aluminum alloy having both superior shear-cutting property and superior dice-skinning property cannot be obtained even when the range of aluminum alloy composition of the present invention is satisfied, if copper and magnesium contents are 3.0 mass % or more and 0.5 mass % or more, respectively. The reason and the relation with the texture of aluminum alloy of the present invention may be as follows.

When a large silicon grain exceeding 30 μm, for example, exists in the aluminum alloy, crack biasing becomes more likely at the time of shear-cutting. Further, in the initial stage of shear-cutting, that is, when a shear-cutting force is exerted on the surface, deformation of the material would be large unless there is generated an appropriate crack, increasing possibility of generation of a void around the large silicon grain. Further, the silicon grain would be fractured and the cracks would be biased. When the amount of deformation of the material increases in this manner, even a silicon grain smaller than 30 μm becomes the cause of crack biasing. Therefore, a phenomenon tends to occur in which crack biasing and deformation affect each other. Therefore, in order to generate an appropriate crack at the initial stage of shear-cutting, it is necessary that the silicon grain size existing in the range of 1.5 mm deep from the surface, to be, by the maximum value, at most 6 μm.

At this time, when the silicon grains have the eutectic composition in which the silicon grains are crystallized with high density at the crystal grain boundary of the matrix as seen after casting of the aluminum alloy disclosed in Japanese Patent Laying-Open No. 64-17834, a crack easily develops biased along the crystal grain boundary, that is, along the region of high density silicon grains. Thus, flatness of the cut surface is lost. Therefore, in order to perform shear-cutting without generating crack biasing at the time of shear-cutting, the aluminum alloy of the present invention is controlled to have any of hot rolled texture, re-crystallized texture or a mixed texture of hot rolled texture and re-crystallized texture, eliminating the cast texture.

The hardness of the material also has an influence on shear-cutting property. When the amount of deformation of the material increases before generation of a crack in the initial stage of shear-cutting, even a silicon grain smaller than 30 μm functions to bias the crack, as described above. Therefore, surface hardness should preferably be at least 50 in accordance with Rockwell hardness F scale. When the surface roughness becomes higher than 90 in accordance with Rockwell hardness F scale, generation of initial crack at the surface of the material becomes too sensitive to the surface roughness. Therefore, the range of the surface hardness is preferably 50 to 90 of Rockwell hardness F scale.

As the surface roughness of the material also has an influence on the shear-cutting property, preferably, it is at most 10 μm in terms of Rmax.

The present invention proposes the aluminum alloy elongate body having the above described characteristics further subjected to dice-skinning process, as the body having highest shear-cutting property. The dice-skinning process removes surface defects and does not generate any spiral kerf step that is unavoidable in the peeling process. Therefore, crack biasing along the step at the time of shear-cutting is avoided.

Fracture of the material generated at the time of dice-skinning process occurs when copper and magnesium added to improve mechanical strength are contained by a large amount, as work hardening capability of these components is high and aluminum alloy reaches the limit of processing. In order to prevent the fracture, generally, it is necessary to lower hardness by softening. When hardness lowers by the softening process, however, peeling off becomes more likely at the time of dice-skinning process. In order to overcome the mutually incompatible problems, in the present invention, the size of the silicon grains is controlled in the manner as described above.

More specifically, the inventors studied improvement of material fracture and suppressing of peeling at the time of dice-skinning process. As a result, it has been found that the size of silicon grains existing within the material is related to the material fracture. Specifically, when a silicon grain larger than 30 μm exists in the material, chevron crack easily occurs in the material. Therefore, the silicon grain size must be 30 μm or smaller, even by the maximum value, and preferably, the size should be 20 μm or smaller.

In order to suppress generation of peeling, it is effective to increase surface hardness of the material. Considering work-hardening at the time of dice-skinning, the surface hardness should preferably be increased to be within a range that prevents fracture during the dice-skinning process. In the appropriate hardness differs dependent on the copper and magnesium contents. Generally, in order to attain the surface hardness after dice-skinning process of 50 to 90 in Rockwell hardness F scale, that is the hardness suitable for shear-cutting, the surface hardness before the dice-skinning process should preferably be adjusted to be in the range of 45 to 85 in Rockwell hardness F scale.

Further, in order to make smooth the surface after skinning, the size of silicon grains existing at the surface to be removed should be 6 μm or smaller, by the maximum value. When the size of the silicon grain at the surface layer exceeds 6 μm, crack biasing becomes more likely at the time of shear-cutting, and in addition, a large scratch of silicon grain results at the time of dice-skinning process.

By such a control of silicon grain size, satisfactory skinning process becomes possible.

Even when the above described control of silicon grain size is performed based on a cast texture, material having such superior shear-cutting property and dice-skinning property as the present invention cannot be obtained. Namely, as the crystal texture of the aluminum alloy in accordance with the present invention has any of hot rolled texture, re-crystallized texture or a mixed texture of hot rolled texture and re-crystallized texture, an aluminum alloy having both superior shear-cutting property and superior dice-skinning property can be obtained.

The amount of skinning at the time of dice-skinning process is also an important condition in manufacturing. When the amount of skinning is excessive, resistance increases at the skinning dice, resulting in fracture of the material and increased material loss. Therefore, preferable amount is at most 1 mm. More preferably, in order to remove surface defects, the amount of skinning should be 0.01 mm to 1 mm.

In order to obtain the inner texture of aluminum alloy as described above, basically, it is preferred to manufacture the aluminum alloy elongate body by using continuous casting rolling method, that combines a caster of movable molding method and a hot roller. The reason is that when a method involving batch type casting and rolling is employed, a re-crystallized grain tends to be large, making cold working of the resulting material difficult.

It is noted that the cooling rate at the time of casting must be controlled such that secondary arm spacing of dendrite is at most 40 μm, so as to attain the silicon grain size controlled in the above described manner. When the secondary arm spacing of dendrite is set to be 40 μm or smaller, the size of iron-based compound precipitated after casting also becomes smaller. When an elongate body is manufactured by the continuous casting rolling method of the present invention using a composite having the basic composition of aluminum alloy of the present invention, the size of iron based compound tends to be coarse, unless the secondary arm spacing of dendrite is controlled in particular. When the secondary arm spacing of the dendrite is not controlled, iron content must be suppressed to be at most 0.2 mass %, in order to attain the shear-cutting property and the dice-skinning property of the present invention. In that case, contents of manganese and chromium that form compounds with iron at the time of casting must also be suppressed to be at most 0.25 mass %.

In the manufacturing method of the present invention, the secondary arm spacing of dendrite is controlled to be at most 40 μm. Accordingly, it becomes possible to increase iron content to 0.3 mass % and the contents of manganese and chromium to 0.3 mass %, respectively. Therefore, an alloy having both superior shear-cutting property and superior dice-skinning property can be obtained even when the iron content is in the range of larger than 0.2 mass % and not larger than 0.3 mass %.

When iron content exceeds 0.3 mass %, however, an iron based compound having the size larger than 20 μm generates, and, similar to a coarse silicon grain, it causes chevron crack at the time of dice-skinning.

Further, in the manufacturing method of the present invention, after casting, hot rolling is performed with the rolling temperature set in the range of 350° C. to 500° C. with the reduction of processing being at least 40%. The reduction of processing is necessary to convert the cast texture to hot rolled texture, re-crystallized texture or the mixed texture of hot rolling texture and re-crystallized texture. The rolling temperature is set in the above described range, because when the temperature is lower than 350° C., rolling becomes difficult because of work-hardening, and when the temperature exceeds 500° C., rolling becomes difficult because of intergranular cracking. The aluminum alloy after hot rolling may be wound in a coil, or cut by a prescribed length to form bar members. In order to make use of the advantage of dice-skinning process, winding in a coil is preferred.

The aluminum alloy in the shape of a coil or a bar is subjected to heat treatment in a temperature range of 300° C. to 480° C. for 2 to 50 hours, in order to adjust hardness, adjust silicon grain diameter and to control crystal grains. When the heat treatment temperature is lower than 300° C., the time for heat treatment would be too long. When the heat treatment temperature exceeds 480° C., small void results from material balance, when copper based compound crystallized in the non-equilibrium state makes a transition to equilibrium state at the time of solidification, and the amount of copper subjected to solid solution increases. The generated void would be a starting point of fracture at the time of dice-skinning, and copper of solid solution increases work hardening capability, making difficult the dice-skinning process.

Examples of the present invention will be described in the following.

Samples having three different inner textures were fabricated for each of the compositions of the present invention and compositions for comparison (unit: mass %) listed in Table 1. The characteristics of the three different inner textures are as shown in the left column of Table 2 in correspondence with the composition number. Samples having inner textures (1) and (2) were fabricated by Properzi continuous casting machine. The samples having inner texture (3) were fabricated by horizontal continuous casting machine.

Cross sectional area of the cast material fabricated by the Properzi continuous casting machine was 3500 $mm^2$, and the casting temperature of molten metal to the casting machine was 650° C. to 690° C. The cast material fabricated by the Properzi continuous casting machine was subjected to hot rolling at a temperature of 420° C. within 5 minutes after completion of solidification, to provide an elongate body having the diameter of 30 mm. The elongate body was wound to a coil having the diameter of 1.7 m. The reduction of processing at this time was 80% in terms of reduction ratio. Samples fabricated by using the Properzi continuous casting machine having inner texture (1) were continuously cast to have secondary arm spacing of dendrite of at most 40 μm, and those having inner texture (2) were continuously cast to have secondary arm spacing of dendrite of at most 50 μm. For the samples having inner texture (1), in order to realize faster cooling rate, the number of cooling nozzles and the amount of cooling water of the Properzi casting machine were increased, and mold material was changed from steel alloy to copper alloy.

Samples having inner texture (3) were fabricated as cast bars having the diameter of 30 mm, in accordance with the method disclosed in Japanese Patent Laying-Open No. 64-17834, using a horizontal continuous casting machine.

Every sample was subjected to heat treatment at a temperature of 450° C. for 8 hours before conducting shear-cutting test.

Table 2 shows details of inner texture and results of comparison in silicon grain diameter, shear-cutting property, fatigue characteristic and wear resistance among the samples fabricated to have three different inner textures (1), (2) and (3) for each of the compositions of the present invention and compositions for comparison. In the column of inner texture of Table 2, the numeral represents, by the unit of μm, "average grain diameter of silicon (maximum grain diameter) maximum grain diameter at the surface". In the column of inner texture of Table 2, "C" represents cast texture, "H" represents hot rolled texture and "R" represents re-crystallized texture.

The shear-cutting test was performed by cutting the samples by a shear cutter, unevenness of the shear surface was visually observed, and defective ratio among 5000 samples was counted for evaluation.

Fatigue test and wear resistance test were performed after T6 processing (heat treatment at 480° C. for 5 hours, followed by quenching in water and aging treatment at 180° C. for 8 hours). In the fatigue test, a dumbbell test piece (a parallel portion having the diameter of 8 mm and GL of 10 mm) was fabricated from each bar material, completely reversed (R=−1) S-n curve was calculated, and fatigue property was evaluated by the stress value of $10^5$ times. In the wear resistance test, a pin/disk type tester was used. To a disk formed of SUJ2 rotating at 600 rpm, a pin having the diameter of 28 mm fabricated from each bar material was pressed with the force of 50 kgf, and amount of reduced weight was measured as the wear amount after the lapse of 300 hours.

Evaluations of shear-cutting property, fatigue characteristic and wear resistance are given by ○ (superior), Δ (good) and X (poor) among the samples having the same composition, in Table 2. When the characteristics were comparable, evaluations are given by the same signs.

TABLE 1

| | Composition No. | Si | Fe | Cu | Mg | Mn | Cr | Sr | Ti |
|---|---|---|---|---|---|---|---|---|---|
| Composition of the Invention | 1 | 7 | 0.01 | 2.1 | 0.3 | 0.01 | 0.01 | 0.01 | 0.02 |
| | 2 | 7 | 0.29 | 2.1 | 0.3 | 0.29 | 0.3 | 0.01 | 0.01 |
| | 3 | 7 | 0.29 | 5 | 0.9 | 0.27 | 0.29 | 0.01 | 0.01 |
| | 4 | 10 | 0.02 | 2 | 0.3 | 0.01 | 0.01 | 0.01 | 0.02 |
| | 5 | 10 | 0.21 | 3 | 0.4 | 0.22 | 0.15 | 0.01 | 0.02 |
| | 6 | 10 | 0.29 | 4.9 | 1 | 0.3 | 0.2 | 0.02 | 0.03 |
| | 7 | 13 | 0.01 | 2 | 0.4 | 0.2 | 0.01 | 0.03 | 0.04 |
| | 8 | 13 | 0.15 | 4.5 | 0.6 | 0.15 | 0.1 | 0.03 | 0.05 |
| | 9 | 13 | 0.3 | 4.9 | 0.9 | 0.3 | 0.29 | 0.03 | 0.05 |
| Comparative Composition | 10 | 7 | 0.32 | 4.9 | 0.3 | 0.28 | 0.28 | 0.03 | 0.05 |
| | 11 | 7 | 0.29 | 4.8 | 0.8 | 0.32 | 0.32 | 0.03 | 0.05 |
| | 12 | 8 | 0.28 | 4.9 | 0.7 | 0.33 | 0.24 | 0.04 | 0.06 |
| | 13 | 7 | 0.24 | 5.2 | 0.9 | 0.1 | 0.1 | 0.03 | 0.05 |
| | 14 | 7 | 0.24 | 4.8 | 1.3 | 0.1 | 0.1 | 0.03 | 0.05 |
| | 15 | 7 | 0.3 | 1.8 | 0.9 | 0.2 | 0.15 | 0.02 | 0.04 |
| | 16 | 12 | 0.31 | 4.8 | 1 | 0.23 | 0.22 | 0.03 | 0.03 |
| | 17 | 13 | 0.23 | 5.3 | 0.8 | 0.22 | 0.01 | 0.02 | 0.02 |
| | 18 | 13 | 0.24 | 2.2 | 1.4 | 0.01 | 0.02 | 0.03 | 0.01 |
| | 19 | 12 | 0.23 | 1.9 | 0.8 | 0.2 | 0.23 | 0.03 | 0.01 |
| | 20 | 15 | 0.2 | 2.1 | 0.32 | 0.02 | 0.1 | 0.03 | 0.04 |
| | 21 | 10 | 0.22 | 3.5 | 0.8 | 0.15 | 0.12 | 0.02 | 0.08 |
| | 22 | 11 | 0.2 | 3.6 | 0.7 | 0.12 | 0.001 | 0.1 | 0.004 |

TABLE 2

| | Composition No. | Inner Texture (1) | | Inner Texture (2) | | Inner Texture (3) | | Shear-cutting Property | | | Fatigue Characteristic | | | Wear Resistance | | |
|---|---|---|---|---|---|---|---|---|---|---|---|---|---|---|---|---|
| | | | | | | | | Inner Texture (1) | Inner Texture (2) | Inner Texture (3) | Inner Texture (1) | Inner Texture (2) | Inner Texture (3) | Inner Texture (1) | Inner Texture (2) | Inner Texture (3) |
| Composition of the Invention | 1 | 8(28)2 | R | 16(32)4 | R | 4(8)6 | C | ○ | Δ | X | ○ | ○ | Δ | ○ | ○ | Δ |
| | 2 | 9(27)3 | H | 18(33)4 | H | 2(7)7 | C | ○ | X | Δ | ○ | X | Δ | ○ | X | Δ |
| | 3 | 5(25)1 | R | 19(37)4 | R | 1(6)5 | C | ○ | X | Δ | ○ | X | Δ | ○ | X | Δ |
| | 4 | 4(24)4 | R | 16(32)3 | R | 0.8(5)5 | C | ○ | Δ | X | ○ | ○ | Δ | ○ | ○ | Δ |
| | 5 | 7(26)2 | R + H | 19(29)7 | R | 0.9(7)6 | C | ○ | Δ | X | ○ | Δ | X | ○ | ○ | Δ |
| | 6 | 7(19)3 | H | 15(35)4 | H | 0.9(5)4 | C | ○ | X | Δ | ○ | X | Δ | ○ | X | Δ |
| | 7 | 4(22)5 | R | 17(38)5 | R | 0.5(4)3 | C | ○ | Δ | X | ○ | ○ | Δ | ○ | ○ | Δ |
| | 8 | 6(26)5 | R | 19(40)6 | R | 0.8(3)3 | C | ○ | Δ | Δ | ○ | ○ | Δ | ○ | ○ | Δ |
| | 9 | 9(29)6 | R + H | 14(34)7 | R + H | 0.2(2)1 | C | ○ | X | Δ | ○ | X | Δ | ○ | X | Δ |
| Comparative Composition | 10 | 8(28)3 | H | 18(32)4 | H | 2(8)7 | C | Δ | X | ○ | Δ | X | ○ | Δ | X | ○ |
| | 11 | 8(29)4 | R + H | 18(31)5 | R + H | 1(7)5 | C | Δ | X | ○ | Δ | X | ○ | Δ | X | ○ |
| | 12 | 8(27)3 | R + H | 19(33)5 | R + H | 2(6)6 | C | Δ | X | ○ | Δ | X | ○ | Δ | X | ○ |
| | 13 | 7(28)4 | R | 19(36)5 | R | 1(5)5 | C | ○ | Δ | ○ | ○ | Δ | ○ | ○ | Δ | ○ |
| | 14 | 6(25)5 | R + H | 20(39)8 | R + H | 0.9(5)5 | C | ○ | Δ | ○ | ○ | Δ | ○ | ○ | Δ | ○ |
| | 15 | 7(26)4 | H | 18(34)7 | H | 0.8(6)4 | C | ○ | Δ | ○ | ○ | Δ | ○ | ○ | Δ | ○ |
| | 16 | 6(28)3 | H | 17(33)4 | H | 0.7(4)4 | C | Δ | X | ○ | Δ | X | ○ | Δ | X | ○ |
| | 17 | 9(27)6 | H | 16(34)8 | H | 0.9(4)3 | C | ○ | Δ | ○ | ○ | Δ | ○ | ○ | Δ | ○ |
| | 18 | 8(25)7 | R + H | 18(37)9 | H | 1(6)5 | C | ○ | Δ | ○ | ○ | Δ | ○ | ○ | Δ | ○ |
| | 19 | 7(27)4 | H | 19(39)6 | H | 0.7(5)4 | C | ○ | Δ | ○ | ○ | Δ | ○ | ○ | Δ | ○ |
| | 20 | 10(50)20 | R | 22(90)35 | R | 1.1(8)6 | C | Δ | Δ | ○ | Δ | X | ○ | Δ | X | ○ |
| | 21 | 6(24)4 | R | 20(38)8 | R | 0.9(7)5 | C | Δ | Δ | ○ | Δ | X | ○ | Δ | X | ○ |
| | 22 | 18(50)20 | H | 24(120)30 | H | 0.8(6)60 | C | Δ | Δ | ○ | Δ | X | ○ | Δ | X | ○ |

As can be seen from Table 2, samples having the inner texture (1) of composition Nos. 1-9 of the present invention (samples of the present invention), that is, aluminum alloy elongate bodies in accordance with the present invention had superior shear-cutting property not observed in the prior art, and in addition, fatigue characteristic and wear resistance comparable to or higher than the prior art, because of the composition and the inner texture.

The influence of silicon grain diameter at the surface, which is another restriction on the inner texture of the aluminum alloy elongate body of the present invention, will be discussed in the following. The ingot fabricated by the Properzi casting machine has a chill layer formed near the surface that is in contact with the mold. In the chill layer, the silicon grains are crystallized in very fine dispersion, and hence an appropriate crack tends to occur at the time of shear-cutting. When the silicon grains in the chill layer are grown, density of the silicon grains decreases, making crack biasing more likely. In an elongate body having reduction of processing of 40% or higher, the chill layer is in the range of down to 1.5 mm deep from the surface. Therefore, control of silicon grains within this range is necessary.

Figure 3:
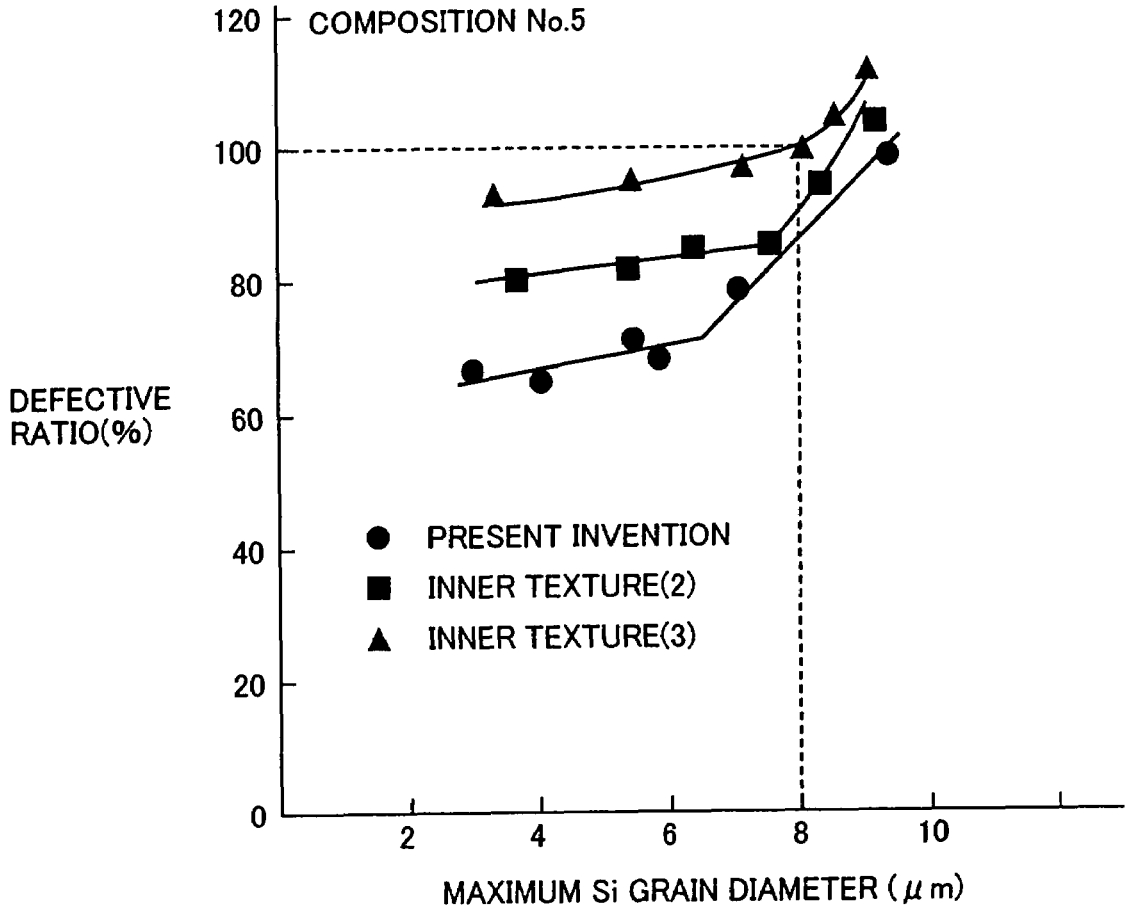
FIG. 3 is a graph representing relation between grain diameter of largest silicon grains existing in the range of down to 1.5 mm deep from the surface and shear-cutting defective ratio.

FIG. 3 represents relation between the maximum silicon (Si) grain diameter existing in the range of down to 1.5 mm from the surface and the shear-cutting defective ratio, when samples having the above described inner textures (1), (2) and (3) of composition No. 5 of the present invention shown in Table 2 were fabricated, with the time of heat treatment at 450° C. changed variously.

Figure 4:
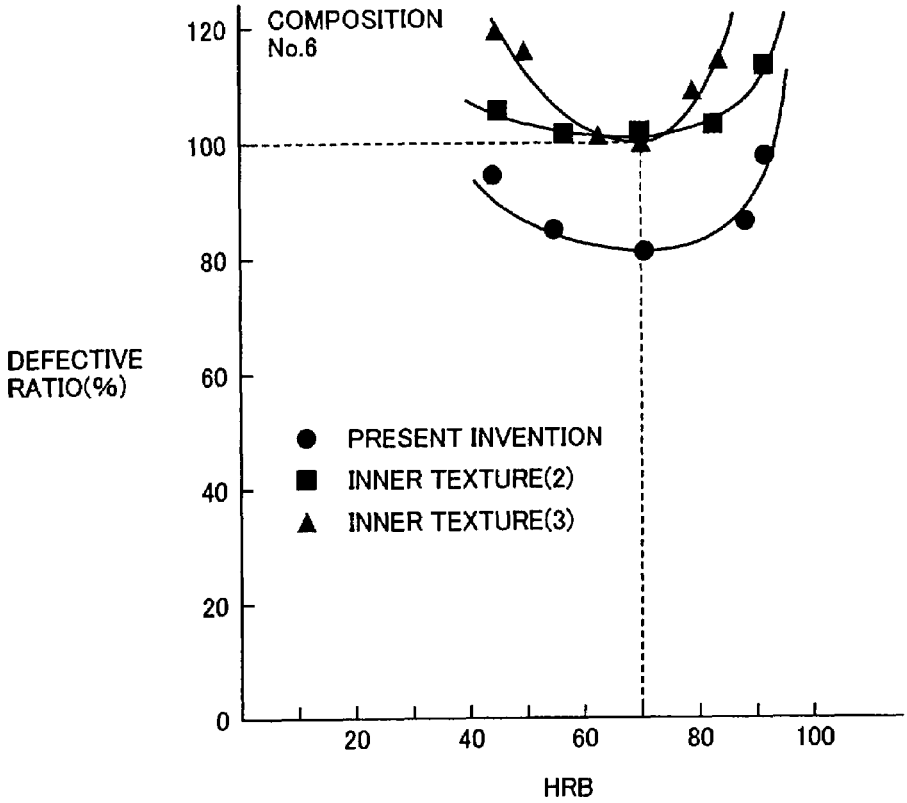
FIG. 4 is a graph representing relation between surface hardness (Rockwell hardness F scale) and shear-cutting defective ratio.
Figure 5:
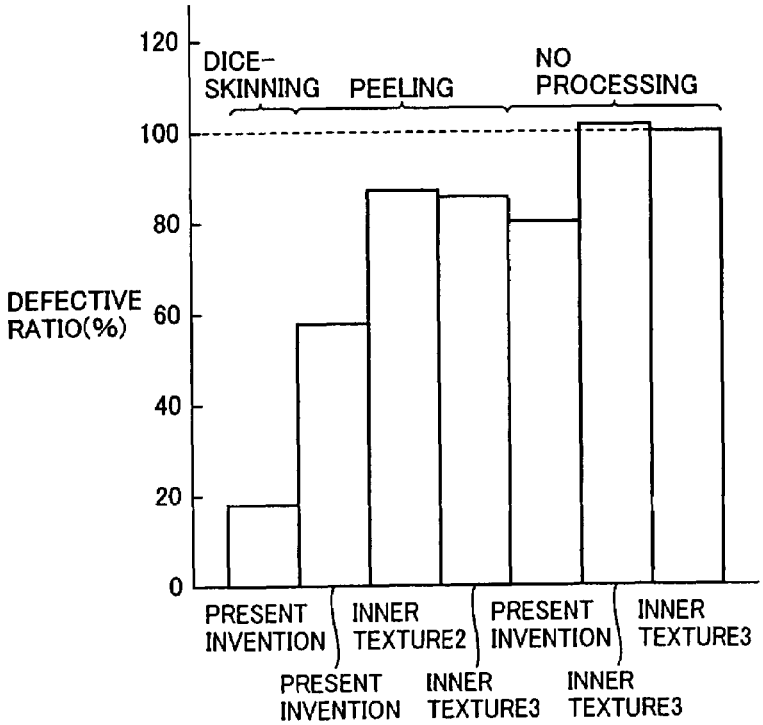
FIG. 5 represents shear-cutting defective ratio after peeling process and dice-skinning process.
Figure 6:
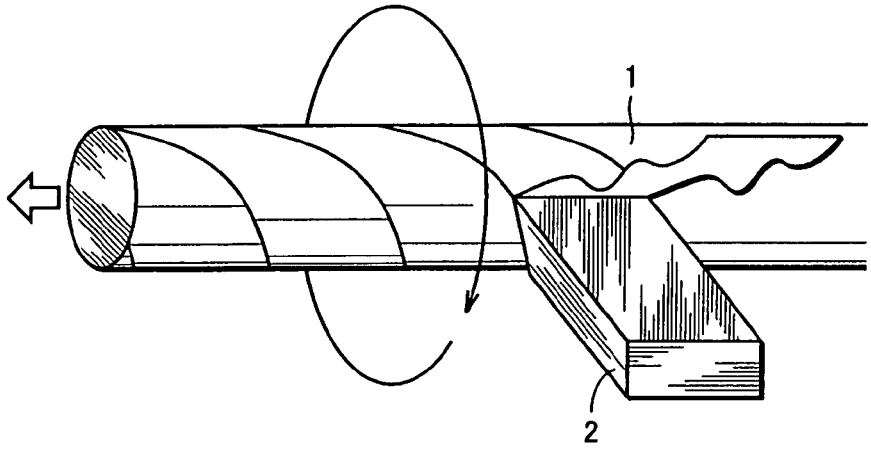
FIG.6 PRIOR ART
FIG. 6 is a schematic illustration representing the peeling process.
Figure 7:
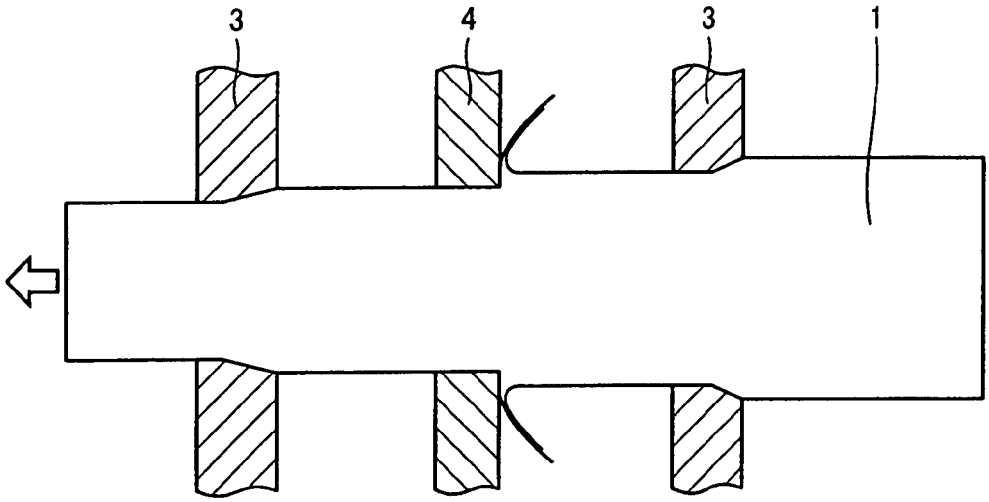
FIG.7 PRIOR ART
FIG. 7 is a schematic illustration representing the dice-skinning process.

In FIG. 3 and FIGS. 4 and 5 that will be referred to data, the defective ratio (%) is given by the following equation, where the number of defective samples having inner texture (3) without any further processing being a reference.

Defective ratio={(number of defects)/number of defects having inner texture (3) without any processing)}×100

The standard for determining successful/unsuccessful shear-cutting will be described in the following. Samples were cut by a shear cutter, unevenness of shear surface was visually observed, and number of defects among 30000 samples was counted. The defects counted were classified into external surface crack, that is, a crack generated at an external surface (peripheral surface) by cutting, and an end surface crack, that is, a crack generated at an end surface (cut surface) of the sample by cutting.

In a strontium-added alloy, smaller silicon grains grow faster because of a mechanism that is considered to be Ostwald ripening, and therefore, in a cast material using Properzi continuous casting machine, silicon grains in the chill layer region grow faster. Therefore, within the studied range of heat treatment, average grain diameter did not exceed 10 μm and maximum grain diameter did not exceed 30 μm among samples having inner texture (1), and average grain diameter did not exceed 20 μm and the maximum grain diameter did not exceed 40 μm among samples having inner texture (2). In samples having inner texture (3), minute silicon grains are dispersed deep inside, because of high cooling rate. Therefore, the maximum silicon grain diameter in the range down to 1.5 mm from the surface and the maximum silicon grain diameter of the entire sample were almost the same.

As is apparent from FIG. 3, when the maximum silicon grain diameter in the range of down to 1.5 mm from the surface exceeds 6 μm, defective ratio increases even when the average grain diameter is at most 10 μm and the maximum grain diameter is at most 30 μm in the entire sample, and the advantage over the prior art material is lost. Similar study was made on samples having Composition Nos. 2 and 8 of the present invention, and the results were similar.

That the shear-cutting property differs dependent on the hardness of aluminum alloy elongate body will be discussed in the following. FIG. 4 represents shear-cutting defective ratio of samples of the alloy elongate body having Composition No. 6 of the present invention shown in Table 2, which were subjected to heat treatment at 480° C. for 5 hours and cooled with various cooling conditions to have different hardnesses (HRB: Rockwell hardness, F scale). Similar to FIG. 3, FIG. 4 represents defective ratio of samples having inner texture (1) (present invention), and samples having inner textures (2) and (3). The samples of the present invention represent particularly satisfactory shear-cutting property with the hardness in the range of 50 to 90 in accordance with Rockwell hardness F scale. Similar study was conducted on samples having Composition Nos. 2 and 8 of the present invention shown in Table 2, and the results were similar.

The defects of shear-cutting test of the aluminum alloy elongate body having inner texture (1) of the present invention shown in Table 2 was inspected, and it was found that surface defect such as a small scratch plays a role. From inspection of the fracture surface, it was found that critical size of the scratch was larger than 10 μm in terms of surface roughness Rmax. In order to remove surface defects, surface cutting is desirable. Here, as the size of the scratch is larger than 10 μm in terms of surface roughness Rmax as mentioned above, it is necessary that the surface roughness is at most 10 μm in Rmax.

Samples having inner textures (1), (2) and (3) of Composition Nos. 3, 6 and 9 of the present invention shown in Table 2 were subjected to peeling process and dice-skinning process. As a result, it was found that the dice-skinning process was impossible on samples having inner textures (2) and (3). FIG. 5 represents shear-cutting defective ratio of respective samples. As can be seen from FIG. 5, shear-cutting defective ratio is low after the dice-skinning process among the samples of the present invention (samples having inner texture (1)). Samples after the peeling process exhibited higher defective ratio as compared with the samples subjected to dice-skinning process. The reason is considered to be a step resulting from blade boundary on the surface, which is unavoidable in view of the nature of the processing. It is noted that the dice-skinning process enabled processing at the linear velocity of 60 m/min, while linear velocity upper limit of the peeling process was 10 m/min.

The ingots fabricated by the Properzi continuous casting machine were studied. As a result, it was found that in order to obtain the aluminum alloy elongate body having the inner texture (1) of the present invention shown in Table 2, continuous casting that ensures secondary arm spacing of dendrite in the cast body to be at most 40 μm was necessary. When casting is performed with low cooling rate not satisfying this condition, the satisfactory shear-cutting property described above cannot be attained. After casting, rolling temperature was varied, and it was found that the ingot could be processed only within the temperature range of 350 to 500° C. Further, the aluminum alloy elongate body in accordance with the present invention described above must have any of hot rolled texture, re-crystallized texture and the mixed texture of hot rolled texture and re-crystallized texture. This is apparent from the fact that most of the cut surfaces that result in defective cast bars in the shear-cutting test of Table 2 were cracked along the cast grain boundary. After casting, samples were picked up from respective rolling stands and studied, and as a result, it was found that the cast texture was almost eliminated when the reduction of processing attained 40%.

With the hardness adjusted in the above described manner, heat treatment for adjusting silicon grain diameter and for controlling crystal grains could be performed at a temperature range of 300 to 480° C. and the time range of 2 to 50 hours.

As for the dice-skinning process, samples of aluminum alloy elongate body having Composition Nos. 3, 6 and 9 of the present invention shown in Table 1 were subjected to heat treatment at 480° C. for 5 hours, and skinning process conditions were studied with the cooling condition changed variously. Cracks were generated when the hardness according to Rockwell hardness F scale was equal to or lower than 30, 34 or 40, respectively. As to the upper limit of hardness, chevron crack was not generated and skinning process was possible up to 98, 96 and 93, respectively, in accordance with Rockwell hardness F scale. When heat treatment step is added after the dice-skinning process, possibility of external damage increases, and therefore, considering work hardening at the time of dice-skinning, the hardness is adjusted as a precaution to be in the range of 45 to 85 in accordance with Rockwell hardness F scale, so that the hardness appropriate for shear-cutting after dice-skinning process, that is, the appropriate hardness range of 50 to 90 in accordance with Rockwell hardness F scale can be attained.

Here, the amount of dice-skinning must not remove the fine silicon particles in the chill layer region at the surface. When the chill layer is removed or when the grains in the chill layer region are grown, crack bias becomes more likely, making dice-skinning process difficult, as confirmed by the dice-skinning test performed on the samples having inner texture (1) (present invention) shown in FIG. 3. Therefore, the dice-skinning process should be performed within the range shallower than 1.5 mm from the surface. Considering mechanical load and material loss, favorable range is the depth of at most 1 mm. Similar study was conducted on Composition Nos. 1 to 9 of the present invention shown in Table 1, and shapes of shavings resulting from the dice-skinning process were compared. Shavings of Composition Nos. 2, 3, 5, 6 and 9 were fragmented into smaller shapes as compared with Composition Nos. 1, 4, 7 and 8. The dice-skinning property was particularly satisfactory when iron content was larger than 0.2 mass % and not larger than 0.3 mass %.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a wear resistant aluminum alloy elongate body, comprising the steps of:

obtaining a cast body by continuously casting an aluminum alloy such that secondary arm spacing of dendrite becomes at most 40 μm;

obtaining a rolled body by hot rolling said cast body in a temperature range of at least 350° C. and at most 500° C. with reduction of processing of at least 40%;

heat-treating said rolled body in a temperature range of at least 300° C. and at most 480° C. for at least 2 hours and at most 50 hours; and performing, after said step of heat treatment, dice-skinning process on a surface of said rolled body, wherein the aluminum alloy contains at least 7 mass % and at most 13 mass % of silicon, at least 0.001 mass % and at most 0.3 mass % of iron, at least 2.0 mass % and at most 5.0 mass % of copper, at least 0.3 mass % and at most 1.0 mass % of magnesium, at least 0.001 mass % and at most 0.3 mass % of manganese, at least 0.001 mass % and at most 0.3 mass % of chromium, at least 0.003 mass % and at most 0.03 mass % of strontium and at least 0.005 mass % and at most 0.05 mass % of titanium, and a remaining part of aluminum and an unavoidable impurity.

2. The method of manufacturing a wear resistant aluminum alloy elongate body according to claim 1, wherein before the step of performing dice-skinning process, surface hardness of said rolled body is controlled to be in a range of at least 45 and at most 85 in accordance with Rockwell hardness F scale.

3. The method of manufacturing a wear resistant aluminum alloy elongate body according to claim 1, wherein in said step of performing dice-skinning process, amount of skinning by the dice is at most 1 mm.

* * * * *